United States Patent [19]

Grund et al.

[11] Patent Number: 4,521,996

[45] Date of Patent: Jun. 11, 1985

[54] CENTRIFUGAL THROWING WHEEL FOR EJECTION OF BLASTING MATERIALS ONTO WORKPIECES

[75] Inventors: Peter Grund, Ekrath; Peter Holz, Linnich, both of Fed. Rep. of Germany

[73] Assignee: Messer Griesheim GmbH, Frankfurt am Main, Fed. Rep. of Germany

[21] Appl. No.: 590,719

[22] Filed: Mar. 19, 1984

[30] Foreign Application Priority Data

Mar. 19, 1983 [DE] Fed. Rep. of Germany ..... 3309941

[51] Int. Cl.[3] ..... B24C 5/06; F04D 29/24

[52] U.S. Cl. ..... 51/434; 416/179; 51/435; 241/275

[58] Field of Search ..... 416/186 R, 203, 175, 416/182, 185, 183, 184, 179; 415/62, 143; 239/225, 246, 249, 214; 51/435, 434, 432, 410, 431, 433; 241/275

[56] References Cited

U.S. PATENT DOCUMENTS

| | | | |
|---|---|---|---|
| 2,217,231 | 10/1940 | Morse | 416/185 |
| 3,694,963 | 10/1972 | Leliaert | 51/434 |
| 3,921,337 | 11/1975 | Maeda | 51/432 |
| 4,253,800 | 3/1981 | Segawa et al. | 416/203 |

FOREIGN PATENT DOCUMENTS 3110062 3/1981 Fed. Rep. of Germany .

*Primary Examiner*—Robert E. Garrett
*Assistant Examiner*—H. Edward Li
*Attorney, Agent, or Firm*—Connolly and Hutz

[57] ABSTRACT

A centrifugal throwing blast wheel is made of two discs which are spaced from each to form a V-shaped outwardly widening slot forming an angle $\alpha$. Sets of diametrically opposed ejection vanes are between the discs. One set has straight throwing faces. Another set has concave faces with a curvature axis inclined toward the plane of rotation at an acute angle greater than $\alpha/2$. A third set has curved faces inclined toward the other side of the plane of rotation.

12 Claims, 4 Drawing Figures

CENTRIFUGAL THROWING WHEEL FOR EJECTION OF BLASTING MATERIALS ONTO WORKPIECES

BACKGROUND OF THE INVENTION

The invention concerns a fan blower or centrifugal throwing wheel for ejection of blasting materials onto workpieces to be blasted.

The blasting technique has long been known. It is used for deburring of molded parts, for roughing up surfaces, compacting, rust removal, removal of scales, removal of lacquer and coating from surfaces, for separation of different materials, peeling of food items, and for mincing. Many blasting processes are possible only with additional heat or cold, e.g., flame blasting, cold deburring of elastomers, removal of lacquer from festooning in varnishing machines, from transport devices and gridirons, for cold mincing and cold peeling of food items. In all applications, a large blasting surface with uniform kinetic blasting energy and density is required.

However, with the currently used throwing wheels, this is not achieved to an optimum degree. These throwing wheels have a relatively simple design and generally consist of two parallel discs with ejection scoops or vanes arranged between them. The vanes are radially arranged fins with smooth or at most slightly profiled ejection or throwing surfaces. The inner surfaces of the two discs or plates are designed to form a V-shaped slot and thus, the distance between them increases outwards from the center. This determines an angle $\alpha$ between the two discs.

Preferably, the blasting material is ejected in the rotation plane of the wheel, while density and energy of the ejected material decrease strongly to the left and to the right of the rotation plane. The blasting pattern of the entire surface on which the blasting material has impacted is thus far from uniform. While there is a very intensive blasting effect and impact frequency in the center of the surface, this decreases significantly towards the edges. This is a great disadvantage in respect to the processing of sensitive workpieces, since on one hand, there will be a large quantity of rejects, i.e., workpieces which have been blasted too strongly or not uniformly enough, and, on the other hand, many workpieces must be reworked, namely if the blasting effect has been insufficient. Furthermore, this is a disadvantage in all blasting treatments executed with additional heat or cold, since there is low utilization of the heat or cold. This is due to the fact that if additional cold is required, more cooling of the workpieces is required than if the blasting effect is uniform. For this reason, devices are used, in which the blasted workpieces are being moved and turned around during the blasting process. Such devices are known, e.g., from the German Patent Document No. 25 16 721 and the German Disclosure Document No. 26 50 202. These known devices ascertain that the workpieces are turned around and that their surfaces are thus uniformly exposed to the blasting material. However, it cannot be achieved that all workpieces are uniformly moved through zones of high blasting density and blasting energy and zones of low blasting density and blasting energy. Disregarding this, such movement of the workpieces is impossible in respect to many workpieces, particularly if they are large.

SUMMARY OF INVENTION

Thus, the object of the invention is to create a centrifugal throwing wheel for ejection of blasting material onto workpieces to be processed, namely one which makes it possible to uniformly affect the workpieces to be processed with the blasting material over the entire blasted surface.

The object is achieved by employing three sets of diametrically opposite radial vanes, each set having different geometric throwing surfaces.

By means of the centrifugal throwing wheel according to the invention, one obtains a blasting effect which could be described as equalized. Due to the curvature of the ejection scoops or vanes, the high concentration of the blasting material in the center of the blasted surface is avoided while a major portion of the blasting material is ejected towards the sides of the blasted surface. An additional advantage is that under otherwise equal conditions, the width of the blasted surface is increased, since the ejection angle is increased as a result of the curvature of the vanes.

Due to the uniform blasting effect which can be achieved with the throwing wheel according to the invention, there is, in addition, a more economical utilization of heat or cold carriers, insofar as these are also applied by means of the throwing wheel.

Due to the concave design of the outlet edge in one set of vanes, it is achieved that the speed components vertical to the blasted surface are the same at all points. Particularly when large pieces are being blasted, this is important if their surface is to have as uniform an appearance as possible. In the preferred embodiment, the throwing wheel according to the invention has only the minimum number of possible vanes, namely six. Since the throwing wheels are frequently manufactured as welded structures, this represents the most inexpensive solution. Nevertheless it is fully sufficient for most applications. However, in special cases, throwing wheels with a greater number of vanes may be used.

THE DRAWINGS

DETAILED DESCRIPTION

Figure 1:
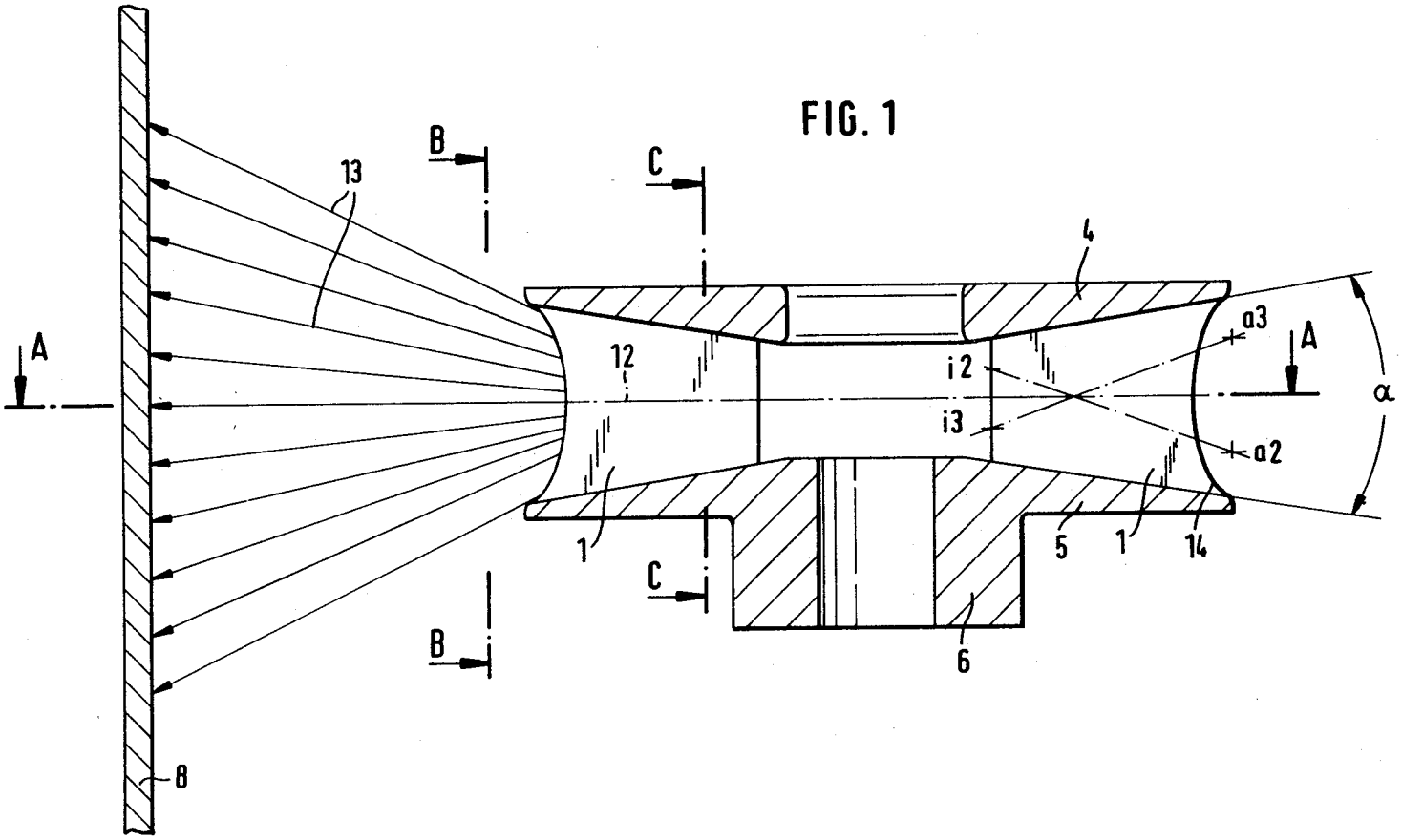
FIG. 1 is a cross-sectional view of a throwing wheel taken along the line D—D in FIG. 2.
Figure 2:
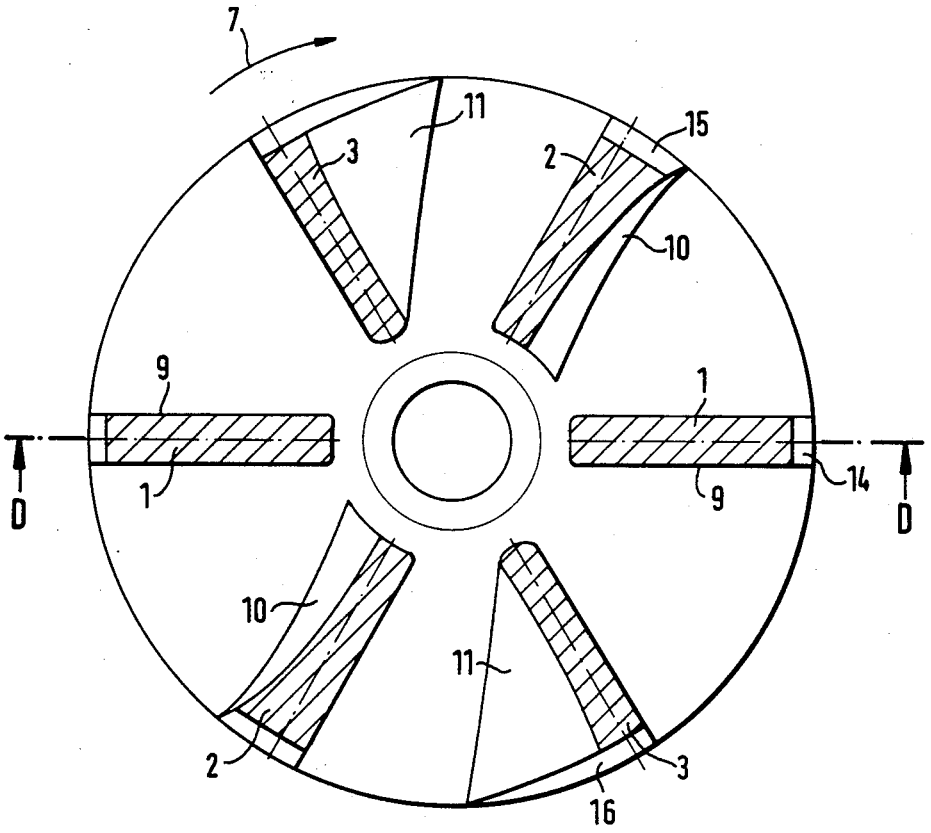
FIG. 2 is a cross-sectional view taken through FIG. 1 along the line A—A.
Figure 3:
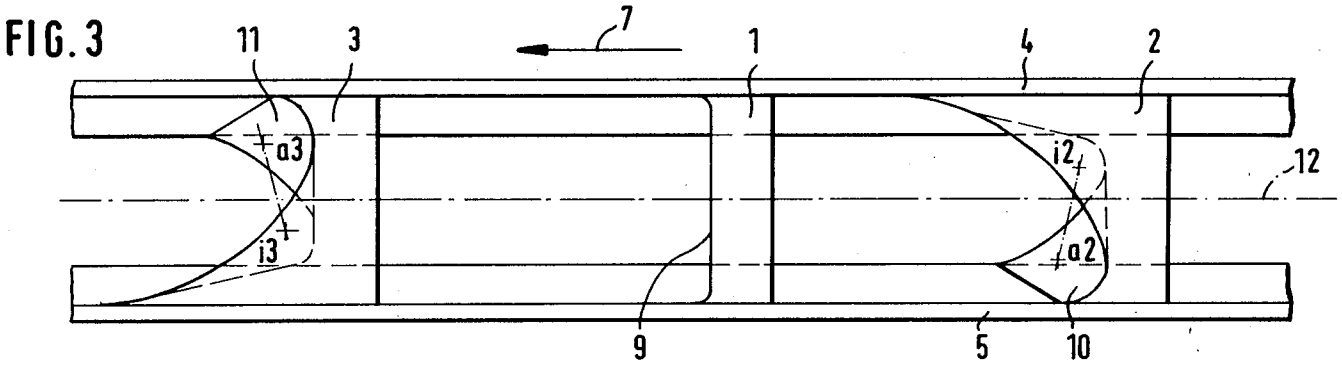
FIG. 3 is a view along the line B—B of FIG. 1.
Figure 4:
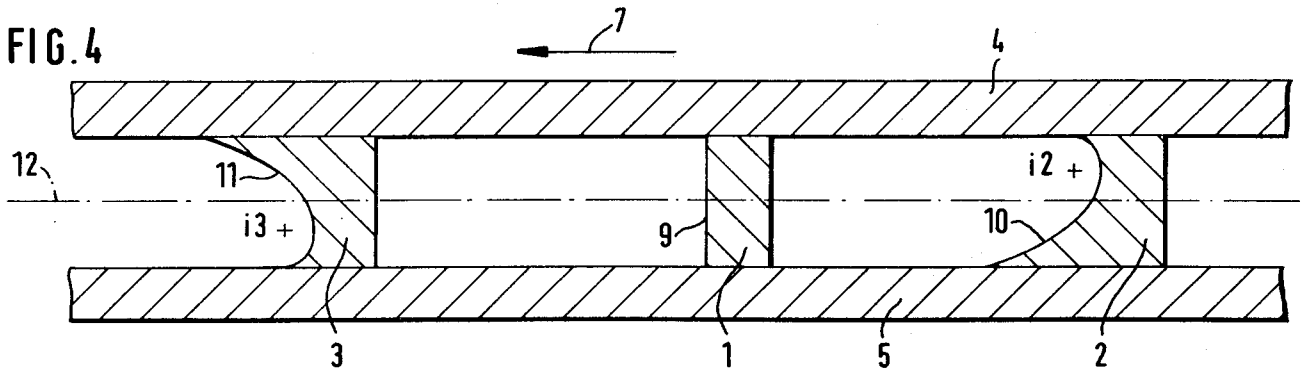
FIG. 4 is a cross-sectional view along the line C—C of FIG. 1.

The centrifugal throwing wheel illustrated in FIGS. 1–4 consists of the two discs 4 and 5 between which are arranged the ejection scoops or vanes 1, 2, 3 and the hub 6. The rotational direction of the wheel is indicated by means of arrows 7.

According to the invention, the wheel has three different types of sets of diametrically opposed vanes which are indicated in the following, for purposes of differentiation, as straight vanes 1, right hand vanes 2 and left hand vanes 3. As can be seen from FIG. 2, the vanes of one type are always located opposite one another. In addition, FIG. 1 also shows a blasted surface 8.

The blasting material arrives into the wheel through the opening opposite the hub 6 and is caught by the ejection or throwing surfaces of the vanes. The straight vanes 1 have the ejection surfaces 9, the right hand vanes 2 have ejection surfaces 10, and the left hand vanes 3 have ejection surfaces 11.

The discs 4 and 5 form a V-shaped slot widening towards the edge. The inner surfaces of the discs are thus located at an angle $\alpha$ to one another.

The straight vanes 1 are designed as straight fins in a manner known per se. However, they may also have other profiles whereby all known designs may be applied. The straight vanes 1 tend to throw the blasting material in the direction of the rotation plane 12. The blasted surface 8 is thus impacted upon mainly in the center portion while its edge areas are only insufficiently affected by the blasting material.

According to the invention, the ejection surfaces of the other vanes have a concave curvature. The curvature axes of the ejection surfaces are represented in the drawings by means of the lines i2–a2 and i3–a3. Thereby "i" stands for inside and "a" for outside, and these are the penetration points of the curvature axes through the inner and outer cylindrical rotation surfaces of the wheel. While the curvature axes i2–a2 and i3–a3 are represented in spatially correct sequence in FIG. 3, they are reversed in the plane of the section in FIG. 1. The curvature axes are inclined towards the rotation plane 12 at an acute angle, but this acute angle is greater than half of the angle $\alpha$. The progressions of the curvature axes i2–a2 and i3–a3 are mirror images of one another.

Due to the curvature of the ejection surfaces according to the invention, it is achieved that the vanes 2 tend to eject the blasting material under an acute angle to the rotation surface 12 onto the blasted surface 8. The vanes 3 correspondingly tend to eject the blasting material to the other side of the surface 8. A significantly advantage of this is the resulting very uniform distribution of the blasting material on the blasted surface 8 which was not possible with the centrifugal throwing wheels used hitherto. An additional advantage is that the ejection angle becomes greater than half of the angle $\alpha$ which is determined by the V-shaped slot between the discs 4 and 5 as can be seen particularly in FIG. 1. In this Figure, the arrows 13 represent the trajectory of the blasting material onto the surface 8. The greater ejection angle approximately corresponds to that angle which is enclosed by the two curvature axes i2–a2 and i3–a3.

As can be seen particularly from FIG. 1, the outlet edges 14, 15, 16 of the vanes 1, 2, 3 have a concave shape oriented towards the rotation axis. This serves to equalize the impact energy of the blasting material. The force components acting vertically on the surface 8 are of primary importance for the blasting effect. Due to the greater diameter, a blasting material particle ejected from the rim of the outlet edge 14 has a greater ejection speed than a particle ejected from the center of the outlet edge 14, since due to the concave shape, the ejection diameter is smaller in the center. However, the speed components, and consequently also the force components oriented vertically onto the surface 8 are at least approximately equal.

The wheel according to the invention can naturally also be used in devices in which the blasting material is redirected by means of reflectors, e.g., as indicated in the German Disclosure Document No. 26 50 202. The conical reflector shown there can be given an additional convex or concave curvature in order to optimize the density of the blasting material. In specific cases, e.g., when the workpieces are large and have cut-outs, reflectors may also be arranged below the blasted work surface in order to return the blasting material passing through the cut-outs and redirect it back to the workpiece. If the blasting material is very hard, e.g., steel pellets, the vanes could be armored by means of an additional welded-on piece.

Usually the optimum progression of the concave curvature of the ejection surfaces of the vanes according to the invention must be established empirically. Hereby, the type of blasting material used, e.g., particles of steel or synthetic materials, and the shape of these as well as the rotation speed of the fan blower wheel constitute significant magnitudes of influence. The curvature axes may also be slightly curved into themselves so that the ejection surfaces have a concave curvature in two planes. Thereby, the blasting material particles can be further accelerated or decelerated in order to influence the blasting effect.

SUMMARY

Centrifugal throwing wheels for ejection of blasting materials on workpieces to be processed consist of two discs which form a V-shaped slot widening outwards and which determine an angle $\alpha$. Between the discs the ejection scoops are arranged which are designed as simple fins or vanes. Due to this geometry of the wheel, the blasting material impacts with varying density and energy upon the surface to be processed. Particularly in respect to sensitive workpieces, this causes excessive amounts of rejects and rework.

In order to realize a more uniform density of the ejected blasting material, three different types of ejection scoops are provided. While the first type is designed in the traditional manner, the two other types have concavely curved ejection surfaces with curvature axes inclined to the rotation plane at an acute angle greater than $\alpha/2$. More uniform energy of the blasting material is obtained by means of concave execution of the outlet edges of the ejection scoops.

What is claimed is:

1. In a centrifugal throwing wheel for the ejection of blasting material onto the workpieces to be processed including two spaced discs forming a V-shaped slot widening outwards at an angle $\alpha$ and with radial vanes arranged between said discs, the improvement being said vanes being arranged in a plurality of uniformly spaced sets of diametrically opposite vanes, the ejection surfaces of one of said sets of vanes having a concave curvature with a curvature axis inclined to the plane of rotation at an acute angle greater than $\alpha/2$, and the ejection surfaces of another of said sets of vanes being curved with a curvature axis inclined toward the other side of said plane of rotation.

2. The wheel according to claim 1, characterized thereby, a further of said sets of vanes having straight ejection surfaces to eject the blasting material symmetrically to said plane of rotation.

3. The wheel according to claim 2, characterized thereby, that said curvature axes are slightly curved into themselves.

4. The wheel according to claim 3, characterized thereby, that the outlet edges of said vanes located between the discs have a concave design.

5. The wheel according to claim 4, characterized thereby, that said sets of vanes comprise three sets.

6. The wheel according to claim 2, characterized thereby, that the outlet edges of said vanes located between the discs have a concave design.

7. The wheel according to claim 6, characterized thereby, that said sets of vanes comprise three sets.

8. The wheel according to claim 2, characterized thereby, that said sets of vanes comprise three sets.

9. In a centrifugal throwing wheel for blasting workpieces to be processed with blasting material and consisting of two discs which form an angle $\alpha$ which widens from the inside toward the outside, and of vanes which are designed in three different styles and whereby, with symmetrical distribution, casting shovels of like design are opposite one another, whereby the ejection surfaces of the first type of vanes is shaped so that they throw the blasting material symmetrically with respect to the plane of rotation and the ejection surfaces of the second type of vanes are curved in a concave manner with an axis of curvature which is inclined with respect to the plane of rotation at an acute angle greater than $\alpha/2$ and the ejection surfaces of the third type of vanes are correspondingly inclined but with a curvature axis inclined on the other side of the plane of rotation.

10. The wheel according to claim 9, characterized therein that the axes are themselves slightly curved.

11. The wheel according to claim 10, characterized by six vanes.

12. The wheel according to claim 9, characterized by six vanes.

* * * * *